US010709260B2

(12) United States Patent
Huang

(10) Patent No.: US 10,709,260 B2
(45) Date of Patent: Jul. 14, 2020

(54) CONNECTING ROD FOLDING MECHANISM AND COT HAVING SAME

(71) Applicant: SHANGHAI DAAFU BABY CARRIER CO., LTD, Shanghai (CN)

(72) Inventor: Shaobao Huang, Shanghai (CN)

(73) Assignee: SHANGHAI DAAFU BABY CARRIER CO., LTD (CN)

( * ) Notice: Subject to any disclaimer, the term of this patent is extended or adjusted under 35 U.S.C. 154(b) by 252 days.

(21) Appl. No.: 15/580,385

(22) PCT Filed: Jun. 24, 2015

(86) PCT No.: PCT/CN2015/082141
§ 371 (c)(1),
(2) Date: Dec. 7, 2017

(87) PCT Pub. No.: WO2016/201709
PCT Pub. Date: Dec. 22, 2016

(65) Prior Publication Data

US 2018/0168365 A1 Jun. 21, 2018

(30) Foreign Application Priority Data

Jun. 13, 2015 (CN) ..... 2015 1 0325564
Jun. 13, 2015 (CN) ..... 2015 2 0411471 U

(51) Int. Cl.
*A47D 7/00* (2006.01)
*A47D 13/06* (2006.01)
(Continued)

(52) U.S. Cl.
CPC ..... *A47D 7/002* (2013.01); *A47D 7/04* (2013.01); *A47D 9/005* (2013.01); *A47D 13/061* (2013.01); *A47D 13/063* (2013.01)

(58) Field of Classification Search
CPC ..... A47D 13/00; A47D 13/06; A47D 13/061; A47D 13/063; A47D 13/066;
(Continued)

(56) References Cited

U.S. PATENT DOCUMENTS 4,448,380 A * 5/1984 Huber-Krattiger ..... A47B 5/04 108/125
4,669,138 A * 6/1987 Kassai ..... A47D 13/063 5/99.1
(Continued)

FOREIGN PATENT DOCUMENTS

CN 103330423 A 10/2013
CN 103349455 A 10/2013
(Continued)

OTHER PUBLICATIONS

International Search Report dated Feb. 25, 2016; International Patent Application No. PCT/CN2015/082141 filed Jun. 24, 2015; ISA/CN.

*Primary Examiner* — Peter M. Cuomo
*Assistant Examiner* — Ifeolu A Adeboyejo
(74) *Attorney, Agent, or Firm* — McDonald Hopkins LLC

(57) ABSTRACT

Provided are a connecting rod folding mechanism and a cot having the same. The connecting rod folding mechanism includes: an upper surrounding joint connecting rod folding mechanism and an corner connecting rod folding mechanism; the corner connecting rod folding mechanism includes an upper connecting rod, a lower connecting rod and a pull-cord rod; the lower connecting rod is connected with the pull-cord rod; the upper connecting rod is connected with an upper surrounding tube; the upper connecting rod is movably connected with the lower connecting rod; the lower connecting rod is arranged in the pull-cord rod; the pull-cord rod is provided with an engaging structure; the lower connecting rod penetrates through the engaging structure
(Continued)

and is connected with a pulling mechanism; the pulling mechanism is arranged in a vertical column; and one end of the vertical column is connected to the corner connecting rod folding mechanism.

14 Claims, 7 Drawing Sheets

(51) Int. Cl.
*A47D 7/04* (2006.01)
*A47D 9/00* (2006.01)

(58) Field of Classification Search
CPC ..... A47D 13/068; A47D 5/00; A47D 7/00; A47D 7/002; A47D 7/007; A47D 9/00; A47D 9/005
See application file for complete search history.

(56) References Cited

U.S. PATENT DOCUMENTS 7,661,156 B2 * 2/2010 Thorne ..... A47D 13/063 5/93.1
7,836,530 B2 * 11/2010 Thorne ..... A47D 13/063 5/93.1
8,060,959 B2 * 11/2011 Thorne ..... A47D 13/063 5/93.1
8,458,829 B2 * 6/2013 Thorne ..... A47D 13/063 5/93.1
8,650,678 B2 * 2/2014 Thorne ..... A47D 13/061 5/93.1
8,756,727 B2 * 6/2014 Thorne ..... A47D 13/063 5/93.1
8,806,674 B2 * 8/2014 Thorne ..... A47D 13/061 5/93.1
8,955,175 B2 * 2/2015 Wiegmann ..... A47D 13/061 256/25
8,973,181 B2 * 3/2015 Thorne ..... A47D 13/063 280/639
9,060,621 B2 * 6/2015 Thorne ..... A47D 13/061
9,756,964 B2 * 9/2017 Yang ..... A47D 9/005
10,188,221 B2 * 1/2019 Rampton ..... A47D 13/063
2008/0189854 A1 * 8/2008 Thorne ..... A47D 13/063 5/99.1
2008/0196163 A1 * 8/2008 Thorne ..... A47D 13/063 5/99.1
2012/0216346 A1 * 8/2012 Rampton ..... A47D 13/063 5/99.1
2012/0248394 A1 * 10/2012 Thorne ..... A47D 13/063 256/25
2013/0240815 A1 * 9/2013 Wiegmann ..... A47D 13/061 256/25
2013/0277948 A1 * 10/2013 Thorne ..... A47D 13/061 280/639
2014/0325756 A1 11/2014 Thorne et al.
2016/0338506 A1 * 11/2016 Yang ..... A47D 9/005
2017/0280892 A1 * 10/2017 Zhang ..... A47D 9/005

FOREIGN PATENT DOCUMENTS

CN 20339989 U 1/2014
CN 203424657 U 2/2014
CN 203468106 U 3/2014
CN 104273978 A 1/2015
CN 104720432 A 6/2015
CN 104771017 A 7/2015
CN 104757823 A 8/2015
CN 204617691 U 9/2015
CN 204617694 U 9/2015

* cited by examiner

CONNECTING ROD FOLDING MECHANISM AND COT HAVING SAME

CROSS-REFERENCE TO RELATED APPLICATION

This application is a 35 U.S.C. 371 national stage filing of PCT Application No. PCT/CN/2015/082141 filed on Jun. 24, 2015, which claims priority to Chinese Patent Application No. 201510325564.7 filed on Jun. 13, 2015; and Chinese Patent Application No. 201520411471.1 filed on Jun. 13, 2015, each of which are incorporated herein in their entirety by reference.

TECHNICAL FIELD

The present disclosure relates to folding devices, and particularly relates to a connecting rod folding mechanism and a cot having the same.

BACKGROUND

Currently, domestic and foreign folding baby cots have many structural joints, and structures are independent and unrelated to each other, causing that all joints are folded and unfolded one by one at aspects of operation and use of the cots, so it is troublesome to unfold and fold the cots.

Therefore, how to provide a folding cot with simple structure and relatively convenient folding is always a direction to focus on study for those skilled in the art.

SUMMARY

The present disclosure provides a connecting rod folding mechanism, including:

an upper surrounding joint connecting rod folding mechanism, including a joint base, and an upper surrounding tube is connected at circular holes on both sides of the joint base;

an corner connecting rod folding mechanism, including a corner base, an upper connecting rod and a lower connecting rod; the lower connecting rod is connected with the corner base through a pivot; the upper surrounding tube is connected with the corner base through the pivot; the corner base is fixed to a vertical column; one end of the upper connecting rod is connected with the upper surrounding tube; the other end of the upper connecting rod is movably connected with one end of the lower connecting rod; and the other end of the lower connecting rod is connected with a pulling mechanism; and a base connecting rod folding mechanism, connected with the vertical column and the pulling mechanism.

In the above connecting rod folding mechanism, the upper surrounding joint connecting rod folding mechanism further includes a pulling cord; the corner connecting rod folding mechanism further includes a pull-cord rod; the lower connecting rod penetrates through the pull-cord rod; one end of the pull-cord rod is connected with the corner base through a pivot; the other end of the pull-cord rod is connected with one end of the pulling cord; and the other end of the pulling cord is connected to the upper surrounding joint connecting rod folding mechanism.

In the above connecting rod folding mechanism, the base connecting rod folding mechanism includes a pulling connecting rod; one end of the pulling connecting rod is connected with a parallel connecting rod; the other end of the pulling connecting rod is connected with the pulling mechanism; and the vertical column is fixed to the base connecting rod folding mechanism.

In the above connecting rod folding mechanism, a positioning block is arranged in the joint base and is located on an adjacent connecting end of the upper surrounding tube.

In the above connecting rod folding mechanism, a joint pin is arranged on one end, connected with the joint base, of the upper surrounding tube; the joint pin is arranged in the upper surrounding tube; a compression spring is arranged in the joint pin; and the other end of the pulling cord is connected to the joint pin in the upper surrounding joint connecting rod folding mechanism.

In the above connecting rod folding mechanism, the pull-cord rod is provided with an engaging structure; the lower connecting rod penetrates through the engaging structure and is connected with the pulling mechanism; the engaging structure is a fan-shaped boss with a groove; the lower connecting rod is provided with a cylindrical pin; and the cylindrical pin is embedded into the groove.

In another aspect of the present disclosure, a cot having the connecting rod folding mechanism is also provided, where the cot includes: an upper surrounding joint connecting rod folding mechanism, an corner connecting rod folding mechanism, a base connecting rod folding mechanism and a central joint; the upper surrounding joint connecting rod folding mechanism is connected with the corner connecting rod folding mechanism; the corner connecting rod folding mechanism is connected with the base connecting rod folding mechanism; and the central joint is connected with the base connecting rod folding mechanism.

In the above folding cot, the upper surrounding joint connecting rod folding mechanism includes a joint base; an upper surrounding tube is connected at circular holes on both sides of the joint base; the corner connecting rod folding mechanism includes a corner base, an upper connecting rod and a lower connecting rod; the lower connecting rod is connected with the corner base through a pivot; the upper surrounding tube is connected with the corner base through the pivot; the corner base is fixed to a vertical column; one end of the upper connecting rod is connected with the upper surrounding tube; the other end of the upper connecting rod is movably connected with one end of the lower connecting rod; the other end of the lower connecting rod is connected with the pulling mechanism; and the base connecting rod folding mechanism is connected with the vertical column and the pulling mechanism.

In the above folding cot, the upper surrounding joint connecting rod folding mechanism further includes a pulling cord; the corner connecting rod folding mechanism further includes a pull-cord rod; the lower connecting rod penetrates through the pull-cord rod; one end of the pull-cord rod is connected with the corner base through a pivot; the other end of the pull-cord rod is connected with one end of the pulling cord; the other end of the pulling cord is connected to the upper surrounding joint connecting rod folding mechanism; the base connecting rod folding mechanism includes a pulling connecting rod; one end of the pulling connecting rod is connected with a parallel connecting rod; the other end of the pulling connecting rod is connected with the pulling mechanism; the vertical column is fixed to the base connecting rod folding mechanism; the pull-cord rod is provided with an engaging structure; the lower connecting rod penetrates through the engaging structure and is connected with the pulling mechanism; the engaging structure is a fan-shaped boss with a groove; the lower connecting rod is provided with a cylindrical pin; and the cylindrical pin is embedded into the groove.

In the above folding cot, an upper surrounding joint connecting rod folding mechanism is arranged on each edge formed by the corner connecting rod folding mechanism in the cot, and the central joint is connected with the corner connecting rod folding mechanism through the base connecting rod folding mechanism.

In the present disclosure, the folding interaction of the connecting rod is realized through the upper surrounding joint connecting rod folding mechanism, the corner connecting rod folding mechanism and the base connecting rod folding mechanism, so that folding can be conveniently performed. The cot having the connecting rod folding mechanism provided in the present disclosure has simple components, is convenient in unfolding and folding, and can realize that easiness of an unfolding process and a folding process of a whole bed body is ensured by only one step.

BRIEF DESCRIPTION OF DRAWINGS

By reading detailed description made to non-limiting embodiments with reference to the following drawings, the present disclosure and features, appearances and advantages of the present disclosure will become more apparent. Identical marks in all the drawings indicate identical parts. The drawings are not drawn intentionally by scale, and emphasis is placed on showing the substance of the present disclosure.

DETAILED DESCRIPTION

In the description below, many concrete details are given so as to provide more thorough understanding of the present disclosure. However, it is apparent for those skilled in the art that the present disclosure may be implemented without one or more of the details. In other examples, to avoid confusion with the present disclosure, some technical features well known in the art are not described.

To thoroughly understand the present disclosure, detailed steps and detailed structures will be proposed in the description below, so as to illustrate a technical solution of the present disclosure. Embodiments of the present disclosure are described in detail as follows. However, in addition to the detailed description, the present disclosure may also have other implementation modes.

Figure 1:
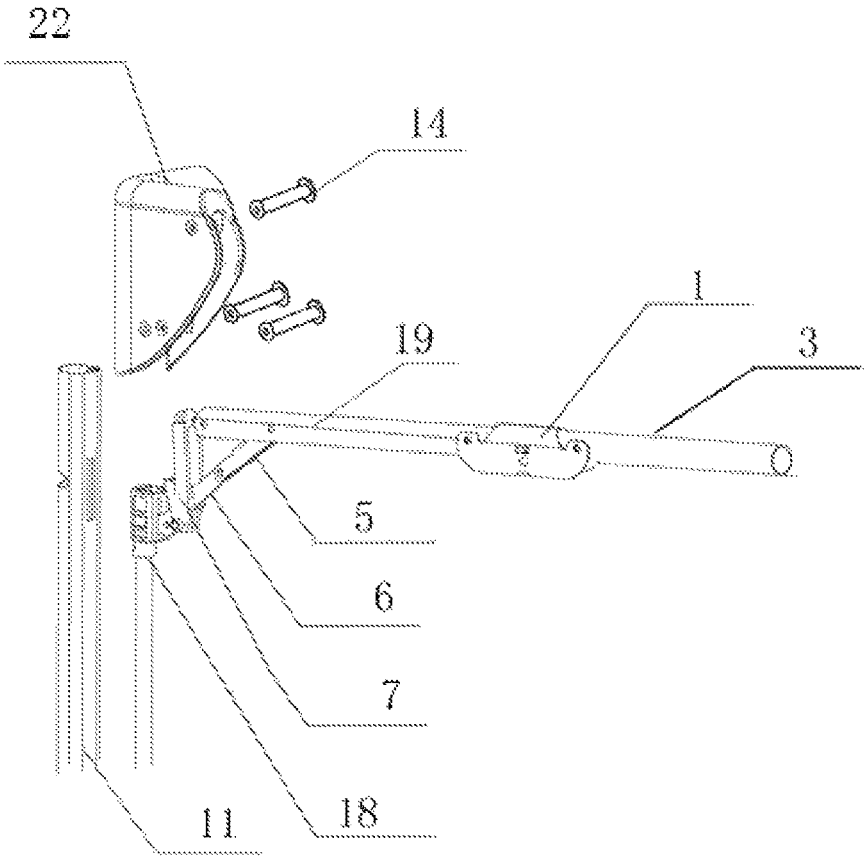
FIG. 1 is a partial decomposition schematic diagram illustrating a connecting rod folding mechanism provided in the present disclosure.
Figure 2:
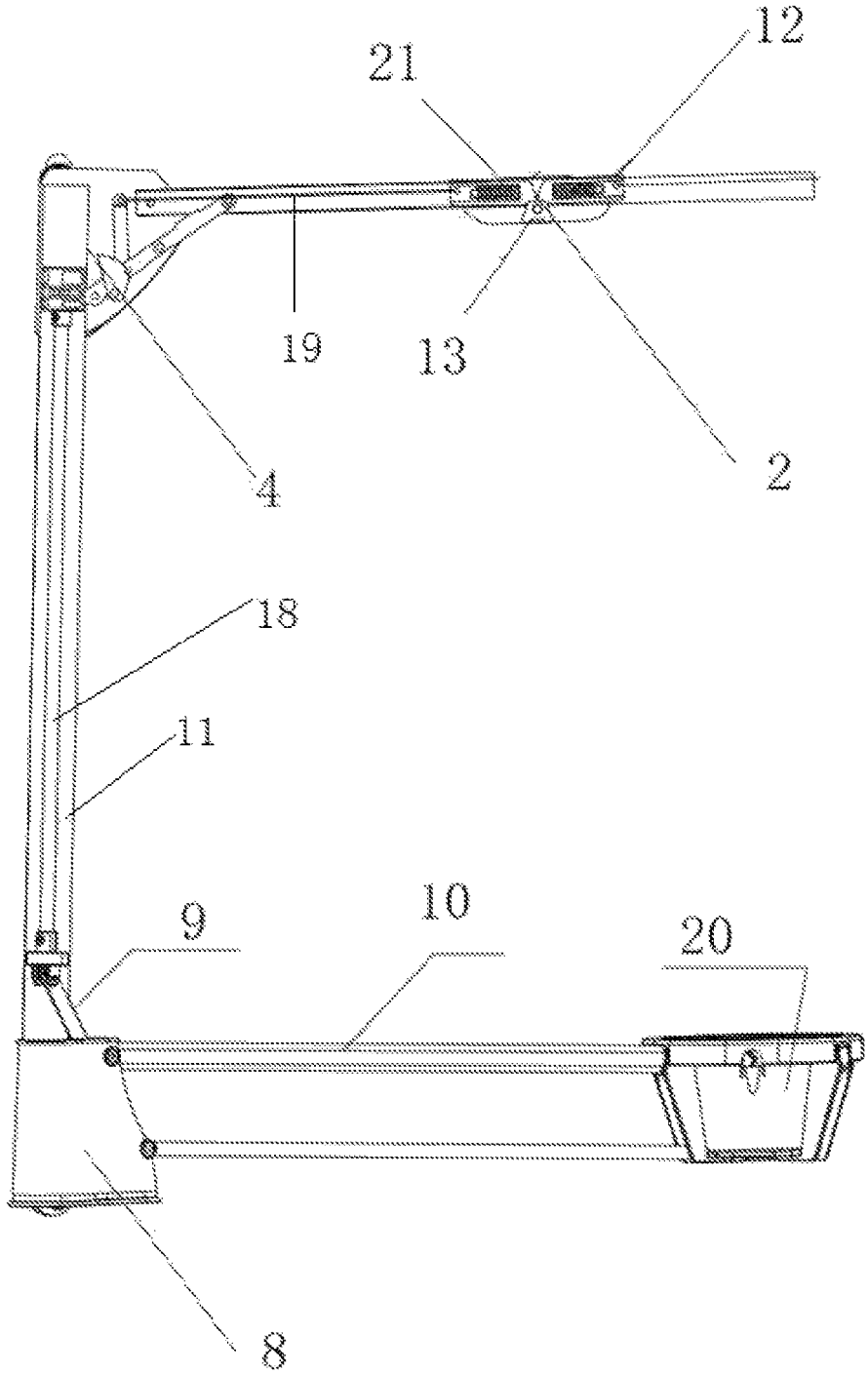
FIG. 2 and FIG. 6 are schematic diagrams illustrating connection between a connecting rod folding mechanism and a central joint provided in the present disclosure.

With reference to FIG. 1 and FIG. 2, the present disclosure provides a connecting rod folding mechanism, including: an upper surrounding joint connecting rod folding mechanism 1, including a joint base 2; an upper surrounding tube 3 is connected at circular holes on both sides of the joint base 2, and the holes here are not necessarily circular holes, and may be in other forms, such as square holes;

an corner connecting rod folding mechanism 4, including an upper connecting rod 5, a lower connecting rod 6 and a corner base 22; the lower connecting rod 6 is connected with the corner base 22 through a pivot 14; the upper surrounding tube 3 is connected with the corner base 22 through the pivot 14; the corner base 22 is fixed to a vertical column 11; one end of the upper connecting rod 5 is connected with the upper surrounding tube 3; the other end of the upper connecting rod 5 is movably connected with one end of the lower connecting rod 6; the other end of the lower connecting rod 6 is connected with a pulling mechanism 18; and a base connecting rod folding mechanism 8, respectively connected with the vertical column 11 and the pulling mechanism 18; a joint base 2 is arranged in the upper surrounding joint connecting rod folding mechanism 1 and an upper surrounding tube 3 is connected at circular holes on both sides of the joint base 2; a folding effect can be realized at a connection place between the joint base 2 and the upper surrounding tube 3; the corner connecting rod folding mechanism 4 includes an upper connecting rod 5, a lower connecting rod 6 and a corner base 22; folding can be realized between the upper connecting rod 5 and the lower connecting rod 6; by installing the pivot 14, the upper connecting rod 5 and the lower connecting rod 6 can rotate around the pivot 14; the other end of the lower connecting rod 6 is connected with a pulling mechanism 18; the base connecting rod folding mechanism 8 is respectively connected with the vertical column 11 and the pulling mechanism 18; and folding conduction can be realized through the pulling mechanism 18, so as to realize interaction between the connecting rod folding mechanisms, so that folding can be conveniently performed. The vertical column 11 in the present embodiment may be a vertical column tube.

In a non-limiting embodiment of the present disclosure, the upper surrounding joint connecting rod folding mechanism 1 further includes a pulling cord 19; the corner connecting rod folding mechanism 4 further includes a pull-cord rod 7; the lower connecting rod 6 penetrates through the pull-cord rod 7; one end of the pull-cord rod 7 is connected with the corner base 22 through a pivot 14; the other end of the pull-cord rod 7 is connected with one end of the pulling cord 19; the other end of the pulling cord 19 is connected to the upper surrounding joint connecting rod folding mechanism 1; and through the pulling cord 19 and the pull-cord rod 7, conduction of a folding effect can be realized more conveniently, so as to realize interaction of the folding effect between the corner connecting rod folding mechanism 4 and the upper surrounding joint connecting rod folding mechanism 1 through the pulling cord 19.

In a non-limiting embodiment of the present disclosure, the base connecting rod folding mechanism 8 includes a pulling connecting rod 9; one end of the pulling connecting rod 9 is connected with a parallel connecting rod 10; the other end of the pulling connecting rod 9 is connected with the pulling mechanism 18; the vertical column 11 is fixed to the base connecting rod folding mechanism 8; and the base connecting rod folding mechanism 8 can realize folding interaction with the corner connecting rod folding mechanism 4 through the pulling connecting rod 9 and the pulling mechanism 18, so as to realize integral interaction among the base connecting rod folding mechanism 8, the corner connecting rod folding mechanism 4 and the upper surrounding joint connecting rod folding mechanism 1. The corner connecting rod folding mechanism 4 in the present disclosure is connected with the base connecting rod folding mechanism 8 through the pulling mechanism 18, and smooth folding in a folding process can be realized through the pulling mechanism 18. The pulling mechanism 18 in the present disclosure may be a pulling rod. Transfer of a folding action is realized through the pulling rod, but the pulling rod is not limited to the pulling mechanism 18 in the present disclosure, and may be replaced by other components as long as the transfer of the folding action can be realized, both of which are within the protection scope of the present disclosure.

In a non-limiting embodiment of the present disclosure, a positioning block 13 is arranged in the joint base 2, and the positioning block 13 is located on an adjacent connecting end of the upper surrounding tube 3. Through the positioning block 13, the upper surrounding tube 3 may be prevented from moving towards a folding direction after the upper surrounding tube 3 is opened, and moreover, the upper surrounding tube 3 may be prevented from being opened after the folding is completed.

In a non-limiting embodiment of the present disclosure, a joint pin 12 is arranged on one end, connected with the joint base 2, of the upper surrounding tube 3; the joint pin 12 is arranged in the upper surrounding tube 3; a compression spring 21 is arranged in the joint pin; by installing the joint pin 12, the upper surrounding tube 3 can be controlled conveniently during folding; the other end of the pulling cord 19 is connected to the joint pin 12 in the upper surrounding joint connecting rod folding mechanism 1; the upper surrounding joint connecting rod folding mechanism 1 is connected with the corner connecting rod folding mechanism 4 through the pulling cord 19; one end of the pulling cord 19 is connected to one end of the joint pin 12; and the other end of the pulling cord 19 is connected to the pull-cord rod 7, so as to realize interaction between the corner connecting rod folding mechanism 4 and the upper surrounding joint connecting rod folding mechanism 1 through the pulling cord 19.

In a non-limiting embodiment of the present disclosure, one end of the pulling connecting rod 9 in the base connecting rod folding mechanism 8 is movably connected with the parallel connecting rod 10 through the pivot 14; and the other end of the pulling connecting rod 9 is movably connected with the pulling mechanism 18 in the vertical column 11, so as to realize the transmission of the folding effect.

Figure 3:
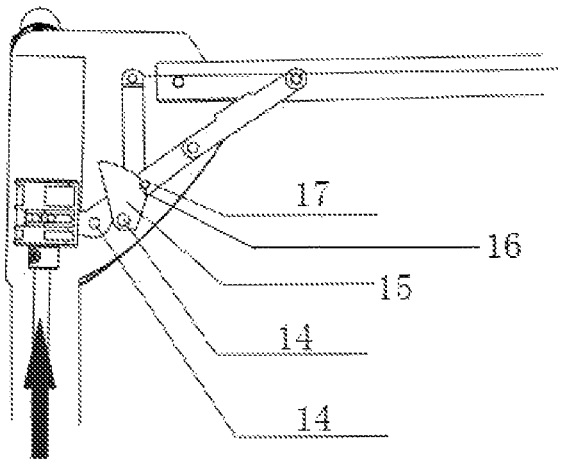
FIG. 3, FIG. 4, FIG. 5 and FIG. 7 are schematic diagrams illustrating folding of a connecting rod folding mechanism in a cot in an embodiment of the present disclosure.
Figure 4:
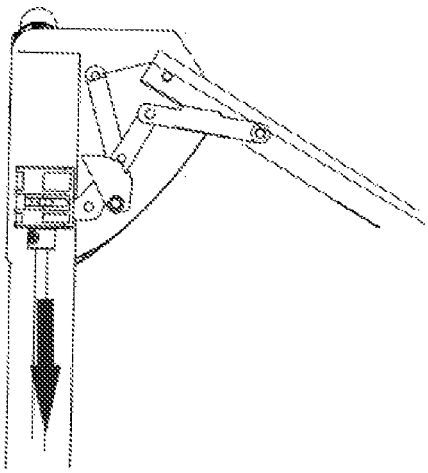
Figure 5:
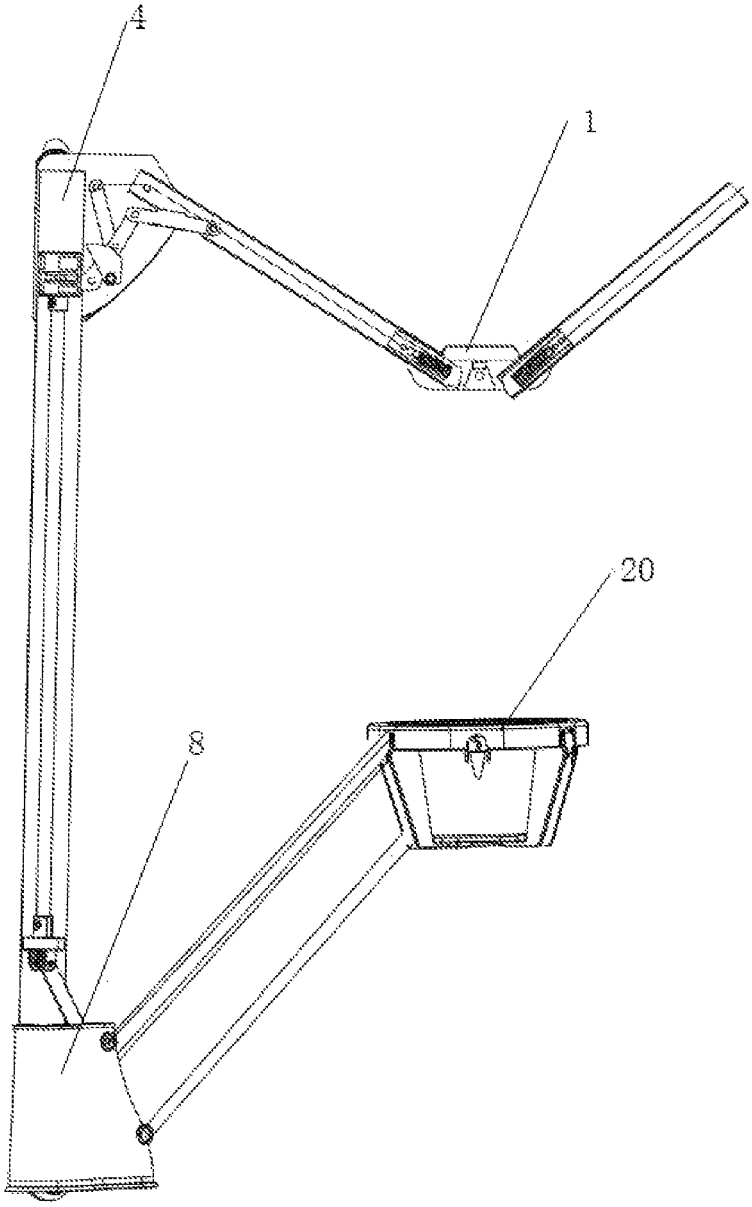
Figure 6:
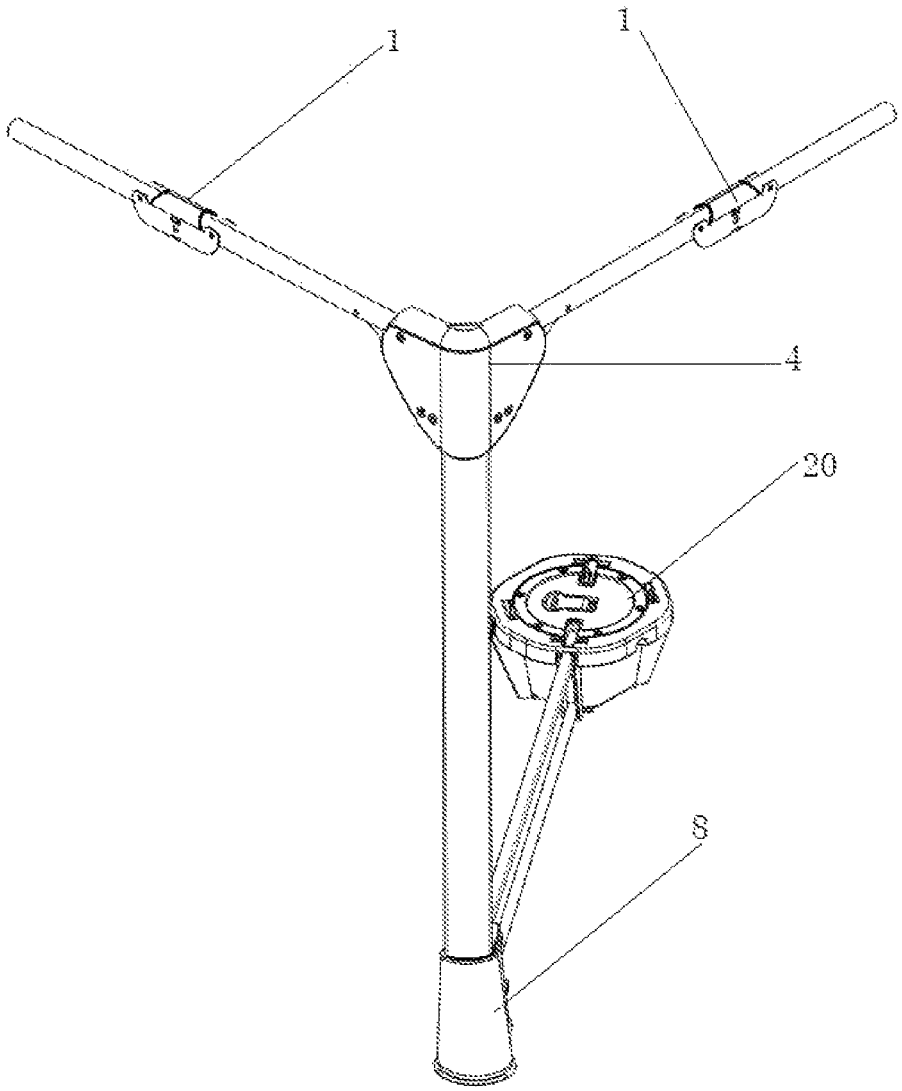
Figure 7:
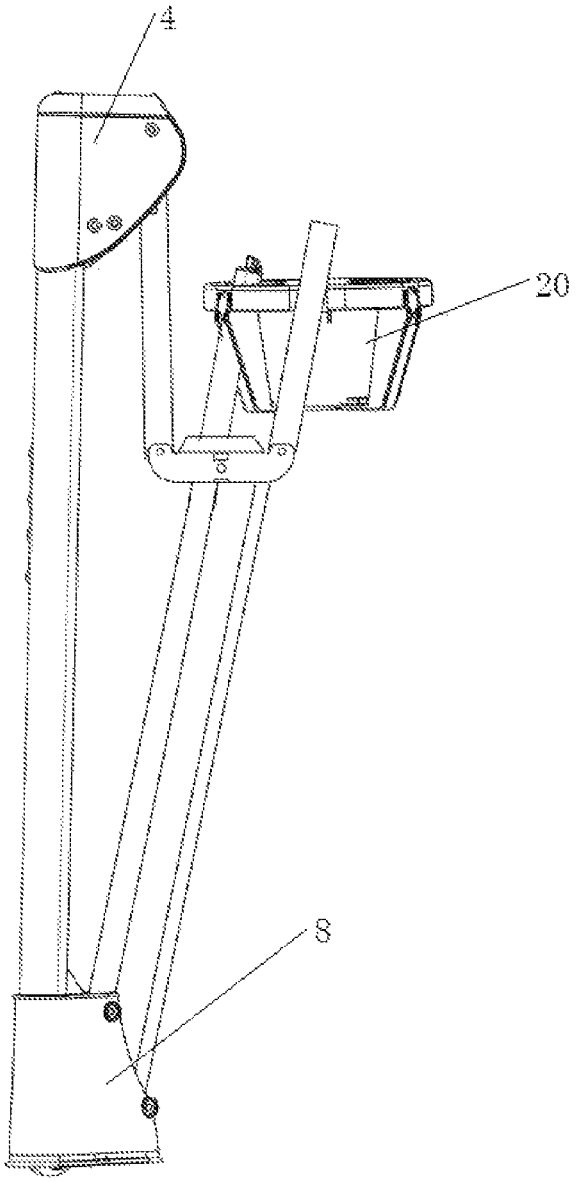

In a non-limiting embodiment of the present disclosure, the pull-cord rod 7 is provided with an engaging structure 15; the lower connecting rod 6 penetrates through the engaging structure 15 and is connected with a pulling mechanism 18; the engaging structure 15 may be a fan-shaped boss and is provided with a groove 16; the lower connecting rod 6 is provided with a cylindrical pin 17; and the cylindrical pin 17 is embedded into the groove 16. In the folding process, the cylindrical pin 17 may push the pull-cord rod 7 to rotate through the fan-shaped boss; the joint pin 12 may be pulled through the pulling cord 19; and the compression spring is arranged in the joint pin 12; as shown in FIG. 4, when the pulling mechanism 18 moves downwards, the lower connecting rod 6 rotates upwards; the cylindrical pin 17 fixed with the lower connecting rod 6 pushes the pull-cord rod 7 interactively to rotate the fan-shaped boss, so as to drive the pulling cord 19 to move outwards; the joint pin 12 is pulled to be separated from the positioning block 13, so that the upper surrounding joint connecting rod folding mechanism 1 is unlocked; the upper surrounding tube 3 rotates downwards to be close to the center, so as to complete the folding process; as shown in FIG. 3, when the pulling connecting rod 9 connected with the other end of the parallel connecting rod 10 (not shown in the drawing and with reference to FIG. 5), the pulling mechanism 18 is pushed upwards; the lower connecting rod 6 rotates downwards; the upper surrounding tube 3 is pushed synchronously with the upper connecting rod 5 and unfolded horizontally; at this moment, the pull-cord rod 7 also rotates forwards synchronously; and the pulling cord 19 resets and locks the joint pin 12 under the effect of the compression spring 21 in the joint pin 12, thereby completing an opening process.

In a non-limiting embodiment of the present disclosure, one end of the pulling connecting rod 9 in the base connecting rod folding mechanism 8 is movably connected with the parallel connecting rod 10 through the pivot 14; a pulling mechanism 18 is arranged in the vertical column 11, and the other end of the pulling connecting rod 9 is movably connected with the pulling mechanism 18 in the vertical column 11, so as to realize the folding conveniently.

The present disclosure also provides a cot having the connecting rod folding mechanism. In combination with FIG. 5, FIG. 6, FIG. 7 and FIG. 8, FIG. 8 shows a baby folding cot adopting the connecting rod folding mechanism provided in the present disclosure. The drawing shows a schematic diagram after the cot is unfolded. When the cot needs to be folded, by upwards lifting the central joint at the center of the cot, steel pipes around the central joint may be gathered to the middle, so as to realize the folding. The cot having the connecting rod folding mechanism includes an upper surrounding joint connecting rod folding mechanism 1, an corner connecting rod folding mechanism 4, a base connecting rod folding mechanism 8 and a central joint 20; the upper surrounding joint connecting rod folding mechanism 1 is connected with the corner connecting rod folding mechanism 4; the corner connecting rod folding mechanism 4 is connected with the base connecting rod folding mechanism 8; and the central joint 20 is connected with the base connecting rod folding mechanism 8. The cot folding structure provided in the present disclosure has simple components; and as long as the central joint at the center of the cot is upwards lifted or downwards pressed, easiness of an unfolding process and a folding process of a whole bed body can be ensured by only one step.

In a non-limiting embodiment of the present disclosure, the upper surrounding joint connecting rod folding mechanism 1 includes a joint base 2; an upper surrounding tube 3 is connected at circular holes on both sides of the joint base 2; the corner connecting rod folding mechanism 4 includes an upper connecting rod 5, a lower connecting rod 6 and a corner base 22; the lower connecting rod 6 is connected with the corner base 22 through the pivot 14; the upper surrounding tube 3 is connected with the corner base 22 through the pivot 14; the corner base 22 is fixed to a vertical column 11; one end of the upper connecting rod 5 is connected with the upper surrounding tube 3; the other end of the upper connecting rod 5 is movably connected with one end of the lower connecting rod 6; the other end of the lower connecting rod 6 is connected with a pulling mechanism 18; the base connecting rod folding mechanism 8 is respectively connected with the vertical column 11 and the pulling mechanism 18; the joint base 2 is arranged in the upper surrounding joint connecting rod folding mechanism 1 and an upper surrounding tube 3 is connected at circular holes on both sides of the joint base 2; a folding effect can be realized at a connection place between the joint base 2 and the upper surrounding tube 3; the corner connecting rod folding mechanism 4 includes an upper connecting rod 5, a lower connecting rod 6 and a corner base 22; folding can be realized between the upper connecting rod 5 and the lower connecting rod 6; by installing the pivot 14, the upper connecting rod 5 and the lower connecting rod 6 may rotate around the pivot 14; the other end of the lower connecting rod 6 is connected with a pulling mechanism 18; the base connecting rod folding mechanism 8 is respectively connected with the vertical column 11 and the pulling mechanism 18; and folding conduction can be realized through the pulling mechanism 18, so as to realize interaction between the connecting rod folding mechanisms of the cot, so that the connecting rod folding mechanisms of the cot can be conveniently folded.

In a non-limiting embodiment of the present disclosure, the upper surrounding joint connecting rod folding mechanism 1 further includes a pulling cord 19; the corner connecting rod folding mechanism 4 further includes a pull-cord rod 7; the lower connecting rod 6 penetrates through the pull-cord rod 7; one end of the pull-cord rod 7 is connected with the corner base 22 through a pivot 14; the other end of the pull-cord rod 7 is connected with one end of the pulling cord 19; the other end of the pulling cord 19 is connected to the upper surrounding joint connecting rod folding mechanism 1; and through the pulling cord 19 and the pull-cord rod 7, conduction of the folding effect can be realized more conveniently, so as to realize interaction between the corner connecting rod folding mechanism 4 and the upper surrounding joint connecting rod folding mechanism 1 through the pulling cord 19. The pull-cord rod 7 is provided with an engaging structure 15; the lower connecting rod 6 penetrates through the engaging structure 15 and is connected with a pulling mechanism 18; the engaging structure 15 is a fan-shaped boss and is provided with a groove 16; the lower connecting rod 6 is provided with a cylindrical pin 17; and the cylindrical pin 17 is embedded into the groove 16. In the folding process, the cylindrical pin 17 may push the pull-cord rod 7 to rotate through the fan-shaped boss; the joint pin 12 may be pulled through the pulling cord 19; and the compression spring is arranged in the joint pin 12; as shown in FIG. 4, when the pulling mechanism 18 moves downwards, the lower connecting rod 6 rotates upwards; the cylindrical pin 17 fixed with the lower connecting rod 6 pushes the pull-cord rod 7 interactively to rotate the fan-shaped boss, so as to drive the pulling cord 19 to move outwards; the joint pin 12 is pulled to be separated from the positioning block 13, so that the upper surrounding joint connecting rod folding mechanism 1 is unlocked; the upper surrounding tube 3 rotates downwards to be close to the center, so as to complete the folding process; as shown in FIG. 3, when the pulling connecting rod 9 connected with the other end of the parallel connecting rod 10 (not shown in the drawing and with reference to FIG. 5), the pulling mechanism 18 is pushed upwards; the lower connecting rod 6 rotates downwards; the upper surrounding tube 3 is pushed synchronously with the upper connecting rod 5 and unfolded horizontally; at this moment, the pull-cord rod 7 also rotates forwards synchronously; and the pulling cord 19 resets and locks the joint pin 12 under the effect of the compression spring 21 in the joint pin 12, thereby completing an opening process of the connecting rod folding mechanism of the cot.

Figure 8:
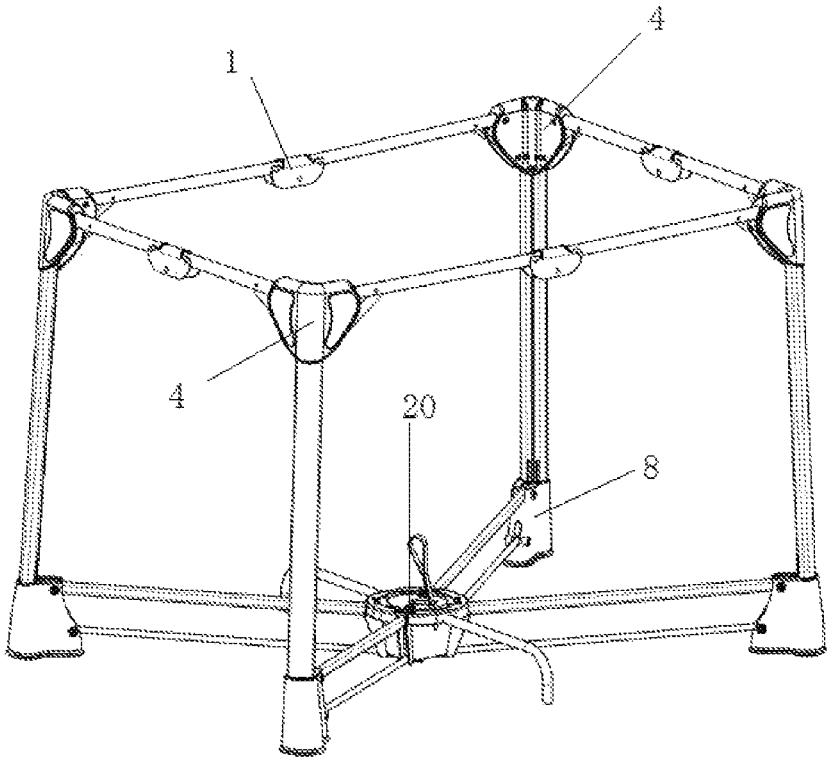
FIG. 8 is a schematic diagram illustrating a cot having a connecting rod folding mechanism.

In a non-limiting embodiment of the present disclosure, an upper surrounding joint connecting rod folding mechanism 1 is arranged on each edge formed by the corner connecting rod folding mechanism 4 in the cot, and the central joint 20 is connected with the corner connecting rod folding mechanism 4 through the base connecting rod folding mechanism 8, so as to form the cot. The upper surrounding joint connecting rod folding mechanism 1, the corner connecting rod folding mechanism 4 and the base connecting rod folding mechanisms 8 may respectively include four groups; an upper surrounding joint connecting rod folding mechanism 1 is arranged on each edge formed by four groups of corner connecting rod folding mechanisms 4; and the central joint 20 is respectively connected with four groups of base connecting rod folding mechanisms 8 through the parallel connecting rod 10. As shown in FIG. 8, a connection mode is provided in the present embodiment, but the present embodiment is not limited to the connection mode.

Two concrete embodiments are provided below to further illustrate the present disclosure.

Embodiment 1

With reference to FIG. 1 and FIG. 2, the present disclosure provides a connecting rod folding mechanism, including: an upper surrounding joint connecting rod folding mechanism 1, where the upper surrounding joint connecting rod folding mechanism 1 includes a joint base 2; an upper surrounding tube 3 is connected at circular holes on both sides of the joint base 2; an corner connecting rod folding mechanism 4, including an upper connecting rod 5, a lower connecting rod 6 and a corner base 22, the lower connecting rod 6 is connected with the corner base 22 through the pivot 14, the upper surrounding tube 3 is connected with the corner base 22 through the pivot 14, the corner base 22 is fixed to a vertical column 11, one end of the upper connecting rod 5 is connected with the upper surrounding tube 3, the other end of the upper connecting rod 5 is movably connected with one end of the lower connecting rod 6, and the other end of the lower connecting rod 6 is connected with a pulling mechanism 18; and a base connecting rod folding mechanism 8, where the base connecting rod folding mechanism 8 is respectively connected with the vertical column 11 and the pulling mechanism 18; the joint base 2 is arranged in the upper surrounding joint connecting rod folding mechanism 1 and an upper surrounding tube 3 is connected at circular holes on both sides of the joint base 2; a folding effect can be realized at a connection place between the joint base 2 and the upper surrounding tube 3; the corner connecting rod folding mechanism 4 includes an upper connecting rod 5, a lower connecting rod 6 and a corner base 22, and folding can be realized between the upper connecting rod 5 and the lower connecting rod 6; by installing the pivot 14, the upper connecting rod 5 and the lower connecting rod 6 may rotate around the pivot 14; the other end of the lower connecting rod 6 is connected with a pulling mechanism 18; the base connecting rod folding mechanism 8 is respectively connected with the vertical column 11 and the pulling mechanism 18; and folding conduction can be realized through the pulling mechanism 18, so as to realize interaction between the connecting rod folding mechanisms, so that folding can be conveniently performed. The upper surrounding joint connecting rod folding mechanism 1 further includes a pulling cord 19; the corner connecting rod folding mechanism 4 further includes a pull-cord rod 7; the lower connecting rod 6 penetrates through the pull-cord rod 7; one end of the pull-cord rod 7 is connected with the corner base 22 through a pivot 14; the other end of the pull-cord rod 7 is connected with one end of the pulling cord 19; the other end of the pulling cord 19 is connected to the upper surrounding joint connecting rod folding mechanism 1; and through the pulling cord 19 and the pull-cord rod 7, conduction of the folding effect can be realized more conveniently, so as to realize interaction between the corner connecting rod folding mechanism 4 and the upper surrounding joint connecting rod folding mechanism 1 through the pulling cord 19. The base connecting rod folding mechanism 8 includes a pulling connecting rod 9; one end of the pulling connecting rod 9 is connected with a parallel connecting rod 10; the other end of the pulling connecting rod 9 is connected with the pulling mechanism 18; the other end of the vertical column 11 is fixed to the base connecting rod folding mechanism 8; and the base connecting rod folding mechanism 8 can realize folding interaction with the corner connecting rod folding mechanism 4 through the pulling connecting rod 9 and the pulling mechanism 18, so as to realize integral interaction among the base connecting rod folding mechanism 8, the corner connecting rod folding mechanism 4 and the upper surrounding joint connecting rod folding mechanism 1. The corner connecting rod folding mechanism 4 in the present disclosure is connected with the base connecting rod folding mechanism 8 through the pulling mechanism 18, and smooth folding in a folding process can be realized through the pulling mechanism 18. The pulling mechanism 18 in the present disclosure may be a pulling rod. Transfer of a folding action is realized through the pulling rod, but the pulling rod is not limited to the pulling mechanism 18 in the present disclosure, and may be replaced by other components as long as the transfer of the folding action can be realized, both of which are within the protection scope of the present disclosure. A positioning block 13 is arranged in the joint base 2, and the positioning block 13 is located on an adjacent connecting end of the upper surrounding tube 3. Through the positioning block 13, the upper surrounding tube 3 may be prevented from moving towards a folding direction after the upper surrounding tube 3 is opened, and moreover, the upper surrounding tube 3 may be prevented from being opened after the folding is completed. A joint pin 12 is arranged on one end, connected with the joint base 2, of the upper surrounding tube 3; the joint pin 12 is arranged in the upper surrounding tube 3; a compression spring 21 is arranged in the joint pin; by installing the joint pin 12, the upper surrounding tube 3 can be controlled conveniently during folding; the other end of the pulling cord 19 is connected to the joint pin 12 in the upper surrounding joint connecting rod folding mechanism 1; the upper surrounding joint connecting rod folding mechanism 1 is connected with the corner connecting rod folding mechanism 4 through the pulling cord 19; one end of the pulling cord 19 is connected to one end of the joint pin 12; and the other end of the pulling cord 19 is connected to the pull-cord rod 7, so as to realize interaction between the corner connecting rod folding mechanism 4 and the upper surrounding joint connecting rod folding mechanism 1 through the pulling cord 19. One end of the pulling connecting rod 9 in the base connecting rod folding mechanism 8 is movably connected with the parallel connecting rod 10 through the pivot 14; and the other end of the pulling connecting rod 9 is movably connected with the pulling mechanism 18 in the vertical column 11, so as to realize the transmission of the folding effect. The pull-cord rod 7 is provided with an engaging structure 15; the lower connecting rod 6 penetrates through the engaging structure 15 and is connected with a pulling mechanism 18; the engaging structure 15 is a fan-shaped boss and is provided with a groove 16; the lower connecting rod 6 is provided with a cylindrical pin 17; and the cylindrical pin 17 is embedded into the groove 16. In the folding process, the cylindrical pin 17 may push the pull-cord rod 7 to rotate through the fan-shaped boss; the joint pin 12 may be pulled through the pulling cord 19; and the compression spring is arranged in the joint pin 12; as shown in FIG. 4, when the pulling mechanism 18 moves downwards, the lower connecting rod 6 rotates upwards; the cylindrical pin 17 fixed with the lower connecting rod 6 pushes the pull-cord rod 7 interactively to rotate the fan-shaped boss, so as to drive the pulling cord 19 to move outwards; the joint pin 12 is pulled to be separated from the positioning block 13, so that the upper surrounding joint connecting rod folding mechanism 1 is unlocked; the upper surrounding tube 3 rotates downwards to be close to the center, so as to complete the folding process; as shown in FIG. 3, when the pulling connecting rod 9 connected with the other end of the parallel connecting rod 10 (not shown in the drawing and with reference to FIG. 5), the pulling mechanism 18 is pushed upwards; the lower connecting rod 6 rotates downwards; the upper surrounding tube 3 is pushed synchronously with the upper connecting rod 5 and unfolded horizontally; at this moment, the pull-cord rod 7 also rotates forwards synchronously; and the pulling cord 19 resets and locks the joint pin 12 under the effect of the compression spring 21 in the joint pin 12, thereby completing an opening process. One end of the pulling connecting rod 9 in the base connecting rod folding mechanism 8 is movably connected with the parallel connecting rod 10 through the pivot 14; a pulling mechanism 18 is arranged in the vertical column 11, and the other end of the pulling connecting rod 9 is movably connected with the pulling mechanism 18 in the vertical column 11, so as to realize the folding conveniently.

Embodiment 2

A cot having a connecting rod folding mechanism, as shown in FIG. 5, FIG. 6, FIG. 7 and FIG. 8, includes an upper surrounding joint connecting rod folding mechanism 1, an corner connecting rod folding mechanism 4, a base connecting rod folding mechanism 8 and a central joint 20; the upper surrounding joint connecting rod folding mechanism 1 is connected with the corner connecting rod folding mechanism 4; the corner connecting rod folding mechanism 4 is connected with the base connecting rod folding mechanism 8; and the central joint 20 is connected with the base connecting rod folding mechanism 8. The upper surrounding joint connecting rod folding mechanism 1 includes a joint base 2; an upper surrounding tube 3 is connected at circular holes on both sides of the joint base 2; the corner connecting rod folding mechanism 4 includes an upper connecting rod 5, a lower connecting rod 6 and a corner base 22, the lower connecting rod 6 is connected with the corner base 22 through the pivot 14, the upper surrounding tube 3 is connected with the corner base 22 through the pivot 14, the corner base 22 is fixed to a vertical column 11, one end of the upper connecting rod 5 is connected with the upper surrounding tube 3, the other end of the upper connecting rod 5 is movably connected with one end of the lower connecting rod 6, and the other end of the lower connecting rod 6 is connected with a pulling mechanism 18; the base connecting rod folding mechanism 8 is respectively connected with the vertical column 11 and the pulling mechanism 18; the joint base 2 is arranged in the upper surrounding joint connecting rod folding mechanism 1 and an upper surrounding tube 3 is connected at circular holes on both sides of the joint base 2; a folding effect can be realized at a connection place between the joint base 2 and the upper surrounding tube 3; the corner connecting rod folding mechanism 4 includes an upper connecting rod 5, a lower connecting rod 6 and a corner base 22, and folding can be realized between the upper connecting rod 5 and the lower connecting rod 6; by installing the pivot 14, the upper connecting rod 5 and the lower connecting rod 6 may rotate around the pivot 14; the other end of the lower connecting rod 6 is connected with a pulling mechanism 18; the base connecting rod folding mechanism 8 is respectively connected with the vertical column 11 and the pulling mechanism 18; and folding conduction can be realized through the pulling mechanism 18, so as to realize interaction between the connecting rod folding mechanisms of the cot, so that the connecting rod folding mechanisms of the cot can be conveniently folded. The upper surrounding joint connecting rod folding mechanism 1 further includes a pulling cord 19; the corner connecting rod folding mechanism 4 further includes a pull-cord rod 7; the lower connecting rod 6 penetrates through the pull-cord rod 7; one end of the pull-cord rod 7 is connected with the corner base 22 through a pivot 14; the other end of the pull-cord rod 7 is connected with one end of the pulling cord 19; the other end of the pulling cord 19 is connected to the upper surrounding joint connecting rod folding mechanism 1; and through the pulling cord 19 and the pull-cord rod 7, conduction of the folding effect can be realized more conveniently, so as to realize interaction between the corner connecting rod folding mechanism 4 and the upper surrounding joint connecting rod folding mechanism 1 through the pulling cord 19. The pull-cord rod 7 is provided with an engaging structure 15; the lower connecting rod 6 penetrates through the engaging structure 15 and is connected with a pulling mechanism 18; the engaging structure 15 is a fan-shaped boss and is provided with a groove 16; the lower connecting rod 6 is provided with a cylindrical pin 17; and the cylindrical pin 17 is embedded into the groove 16. In the folding process, the cylindrical pin 17 may push the pull-cord rod 7 to rotate through the fan-shaped boss; the joint pin 12 may be pulled through the pulling cord 19; and the compression spring is arranged in the joint pin 12; as shown in FIG. 4, when the pulling mechanism 18 moves downwards, the lower connecting rod 6 rotates upwards; the cylindrical pin 17 fixed with the lower connecting rod 6 pushes the pull-cord rod 7 interactively to rotate the fan-shaped boss, so as to drive the pulling cord 19 to move outwards; the joint pin 12 is pulled to be separated from the positioning block 13, so that the upper surrounding joint connecting rod folding mechanism 1 is unlocked; the upper surrounding tube 3 rotates downwards to be close to the center, so as to complete the folding process of the connecting rod folding mechanisms of the cot; as shown in FIG. 3, when the pulling connecting rod 9 connected with the other end of the parallel connecting rod 10 (not shown in the drawing and with reference to FIG. 5), the pulling mechanism 18 is pushed upwards; the lower connecting rod 6 rotates downwards; the upper surrounding tube 3 is pushed synchronously with the upper connecting rod 5 and unfolded horizontally; at this moment, the pull-cord rod 7 also rotates forwards synchronously; and the pulling cord 19 resets and locks the joint pin 12 under the effect of the compression spring 21 in the joint pin 12, thereby completing an opening process of the connecting rod folding mechanisms of the cot. An upper surrounding joint connecting rod folding mechanism 1 is arranged on each edge formed by the corner connecting rod folding mechanism 4 in the cot, and the central joint 20 is connected with the corner connecting rod folding mechanism 4 through the base connecting rod folding mechanism 8, so as to form the cot. The upper surrounding joint connecting rod folding mechanism 1, the corner connecting rod folding mechanism 4 and the base connecting rod folding mechanisms 8 may respectively include four groups; an upper surrounding joint connecting rod folding mechanism 1 is arranged on each edge formed by four groups of corner connecting rod folding mechanisms 4; and the central joint 20 is respectively connected with four groups of base connecting rod folding mechanisms 8 through the parallel connecting rod 10. The present embodiment is realized as follows: the joint pin 12 may be pulled through the pulling cord 19; and the compression spring 21 is arranged in the joint pin 12; as shown in FIG. 4, when the pulling mechanism moves downwards, the lower connecting rod 6 rotates upwards; the cylindrical pin 17 fixed with the lower connecting rod 6 pushes the pull-cord rod 7 interactively to rotate the fan-shaped boss, so as to drive the pulling cord 19 to move outwards; the joint pin 12 is pulled to be separated from the positioning block 13, so that the upper surrounding joint connecting rod folding mechanism 1 is unlocked; the upper surrounding tube 3 rotates downwards to be close to the center, so as to complete the folding process; as shown in FIG. 3, when the pulling connecting rod 9 connected with the other end of the parallel connecting rod 10 (not shown in the drawing and with reference to FIG. 5), the pulling mechanism 18 is pushed upwards; the lower connecting rod 6 rotates downwards; the upper surrounding tube 3 is pushed synchronously with the upper connecting rod 5 and unfolded horizontally; at this moment, the pull-cord rod 7 also rotates forwards synchronously; and the pulling cord 19 resets and locks the joint pin 12 under the effect of the compression spring 21 in the joint pin 12, thereby completing an opening process. An upper surrounding joint connecting rod folding mechanism 1 is arranged on each edge formed by the corner connecting rod folding mechanism 4 in the cot, and the central joint 20 is connected with the corner connecting rod folding mechanism 4 through the base connecting rod folding mechanism 8, so as to form the cot. The upper surrounding joint connecting rod folding mechanism 1, the corner connecting rod folding mechanism 4 and the base connecting rod folding mechanisms 8 may respectively include four groups; an upper surrounding joint connecting rod folding mechanism 1 is arranged on each edge formed by four groups of corner connecting rod folding mechanisms 4; and the central joint 20 is respectively connected with four groups of base connecting rod folding mechanisms 8 through the parallel connecting rod 10. As shown in FIG. 8, a connection mode is provided in the present embodiment, but the present embodiment is not limited to the connection mode. The cot folding structure provided in the present disclosure has simple components; and as long as the central joint at the center of the cot is upwards lifted or downwards pressed, easiness of an unfolding process and a folding process of a whole bed body can be ensured by only one step.

In summary, since the above technical solution is adopted in the present disclosure, the joint base is arranged in the upper surrounding joint connecting rod folding mechanism and an upper surrounding tube is connected at circular holes on both sides of the joint base; the corner connecting rod folding mechanism includes an upper connecting rod, a lower connecting rod and a pull-cord rod; the base connecting rod folding mechanism includes a pulling connecting rod; one end of the pulling connecting rod is connected with a parallel connecting rod; and the other end of the pulling connecting rod is connected with the vertical column, so as to realize the interaction in the folding process, so that folding can be conveniently performed. In the cot having the connecting rod folding mechanism provided in the present disclosure, the joint pin is arranged in the joint base; the compression spring is arranged in the joint pin; a positioning block is also arranged in the joint base; the fan-shaped boss is arranged in the corner connecting rod folding mechanism and a cylindrical pin is arranged on the lower connecting rod; and as long as the central joint at the center of the cot is upwards lifted or downwards pressed, easiness of an unfolding process and a folding process of a whole bed body can be ensured by only one step.

Embodiments of the present disclosure are described above. It should be understood that the present disclosure is not limited to the above specific implementation mode, and equipments and structures not described in detail should be interpreted to be implemented in an ordinary mode in the art. Many possible changes and modifications, or amendments as equivalent embodiments with equivalent changes may be made to the technical solution of the present disclosure by those skilled acquainted with the art using the methods and technical contents revealed above without departing from the scope of the technical solution of the present disclosure, which will not influence the substantial content of the present disclosure. Therefore, any simple amendment, equivalent change and modification made to the above embodiments based on the technical substance of the present disclosure without departing from the contents of the technical solution of the present disclosure still belong to the protection scope of the technical solution of the present disclosure.

What is claimed is:

1. A connecting rod folding mechanism, comprising:

an upper surrounding joint connecting rod folding mechanism, comprising a joint base and a pulling cord; an upper surrounding tube is connected at circular holes on both sides of the joint base;

an corner connecting rod folding mechanism, comprising a corner base, an upper connecting rod, a lower connecting rod and a pull-cord rod; the lower connecting rod is connected with the corner base through a pivot; the upper surrounding tube is connected with the corner base through the pivot; the corner base is fixed to a vertical column; one end of the upper connecting rod is connected with the upper surrounding tube; the other end of the upper connecting rod is movably connected with one end of the lower connecting rod; and the other end of the lower connecting rod is connected with a pulling mechanism; the lower connecting rod penetrates through the pull-cord rod; one end of the pull-cord rod is connected with the corner base through a pivot; the other end of the pull-cord rod is connected with one end of the pulling cord; and the other end of the pulling cord is connected to the upper surrounding joint connecting rod folding mechanism; and a base connecting rod folding mechanism, connected with the vertical column and the pulling mechanism.

2. The connecting rod folding mechanism of claim 1, wherein the base connecting rod folding mechanism comprises a pulling connecting rod; one end of the pulling connecting rod is connected with a parallel connecting rod; the other end of the pulling connecting rod is connected with the pulling mechanism; and the vertical column is fixed to the base connecting rod folding mechanism.

3. The connecting rod folding mechanism of claim 1, wherein a positioning block is arranged in the joint base and is located on an adjacent connecting end of the upper surrounding tube.

4. The connecting rod folding mechanism of claim 1, wherein a joint pin is arranged on one end, connected with the joint base, of the upper surrounding tube; the joint pin is arranged in the upper surrounding tube; a compression spring is arranged in the joint pin; and the other end of the pulling cord is connected to the joint pin in the upper surrounding joint connecting rod folding mechanism.

5. The connecting rod folding mechanism of claim 1, wherein the pull-cord rod is provided with an engaging structure; the lower connecting rod penetrates through the engaging structure and is connected with the pulling mechanism; the engaging structure is a fan-shaped boss with a groove; the lower connecting rod is provided with a cylindrical pin; and the cylindrical pin is embedded into the groove.

6. A cot having a connecting rod folding mechanism, comprising: an upper surrounding joint connecting rod folding mechanism, an corner connecting rod folding mechanism, a base connecting rod folding mechanism and a central joint; the upper surrounding joint connecting rod folding mechanism is connected with the corner connecting rod folding mechanism; the corner connecting rod folding mechanism is connected with the base connecting rod folding mechanism; and the central joint is connected with the base connecting rod folding mechanism; wherein the upper surrounding joint connecting rod folding mechanism comprises a joint base and a pulling cord; an upper surrounding tube is connected at circular holes on both sides of the joint base;

the corner connecting rod folding mechanism comprises a corner base, an upper connecting rod and a lower connecting rod; the lower connecting rod is connected with the corner base through a pivot; the upper surrounding tube is connected with the corner base through the pivot; the corner base is fixed to a vertical; column; one end of the upper connecting rod is connected with the upper surrounding tube; the other end of the upper connecting rod is movably connected with one end of the lower connecting rod; and the other end of the lower connecting rod is connected with a pulling mechanism; the lower connecting rod penetrates through a pull-cord rod; one end of the pull-cord rod is connected with the corner base through a pivot; the other end of the pull-cord rod is connected with one end of the pulling cord; and the other end of the pulling cord is connected to the upper surrounding joint connecting rod folding mechanism; and the base connecting rod folding mechanism is connected with the vertical column and the pulling mechanism.

7. The cot having the connecting rod folding mechanism of claim 6, wherein the upper surrounding joint connecting rod folding mechanism comprises a joint base; an upper surrounding tube is connected at circular holes on both sides of the joint base; the corner connecting rod folding mechanism comprises a corner base, an upper connecting rod and a lower connecting rod; the lower connecting rod is connected with the corner base through a pivot; the upper surrounding tube is connected with the corner base through the pivot; the corner base is fixed to a vertical column; one end of the upper connecting rod is connected with the upper surrounding tube; the other end of the upper connecting rod is movably connected with one end of the lower connecting rod; the other end of the lower connecting rod is connected with the pulling mechanism; and the base connecting rod folding mechanism is connected with the vertical column and the pulling mechanism.

8. The cot having the connecting rod folding mechanism of claim 6, wherein the corner connecting rod folding mechanism further comprises a pull-cord rod; the base connecting rod folding mechanism comprises a pulling connecting rod; one end of the pulling connecting rod is connected with a parallel connecting rod; the other end of the pulling connecting rod is connected with the pulling mechanism; the vertical column is fixed to the base connecting rod folding mechanism; the pull-cord rod is provided with an engaging structure; the lower connecting rod penetrates through the engaging structure and is connected with the pulling mechanism; the engaging structure is a fan-shaped boss with a groove; the lower connecting rod is provided with a cylindrical pin; and the cylindrical pin is embedded into the groove.

9. The cot having the connecting rod folding mechanism of claim 8, wherein an upper surrounding joint connecting rod folding mechanism is arranged on each edge formed by the corner connecting rod folding mechanism in the cot, and the central joint is connected with the corner connecting rod folding mechanism through the base connecting rod folding mechanism.

10. The connecting rod folding mechanism of claim 2, wherein the pull-cord rod is provided with an engaging structure; the lower connecting rod penetrates through the engaging structure and is connected with the pulling mechanism; the engaging structure is a fan-shaped boss with a groove; the lower connecting rod is provided with a cylindrical pin; and the cylindrical pin is embedded into the groove.

11. The connecting rod folding mechanism of claim 3, wherein the pull-cord rod is provided with an engaging structure; the lower connecting rod penetrates through the engaging structure and is connected with the pulling mechanism; the engaging structure is a fan-shaped boss with a groove; the lower connecting rod is provided with a cylindrical pin; and the cylindrical pin is embedded into the groove.

12. The connecting rod folding mechanism of claim 4, wherein the pull-cord rod is provided with an engaging structure; the lower connecting rod penetrates through the engaging structure and is connected with the pulling mechanism; the engaging structure is a fan-shaped boss with a groove; the lower connecting rod is provided with a cylindrical pin; and the cylindrical pin is embedded into the groove.

13. The cot having the connecting rod folding mechanism of claim 7, wherein the upper surrounding joint connecting rod folding mechanism further comprises a pulling cord; the corner connecting rod folding mechanism further comprises a pull-cord rod; the lower connecting rod penetrates through the pull-cord rod; one end of the pull-cord rod is connected with the corner base through a pivot; the other end of the pull-cord rod is connected with one end of the pulling cord; the other end of the pulling cord is connected to the upper surrounding joint connecting rod folding mechanism; the base connecting rod folding mechanism comprises a pulling connecting rod; one end of the pulling connecting rod is connected with a parallel connecting rod; the other end of the pulling connecting rod is connected with the pulling mechanism; the vertical column is fixed to the base connecting rod folding mechanism; the pull-cord rod is provided with an engaging structure; the lower connecting rod penetrates through the engaging structure and is connected with the pulling mechanism; the engaging structure is a fan-shaped boss with a groove; the lower connecting rod is provided with a cylindrical pin; and the cylindrical pin is embedded into the groove.

14. The cot having the connecting rod folding mechanism of claim 13, wherein an upper surrounding joint connecting rod folding mechanism is arranged on each edge formed by the corner connecting rod folding mechanism in the cot, and the central joint is connected with the corner connecting rod folding mechanism through the base connecting rod folding mechanism.

* * * * *